United States Patent [19]

Bell et al.

[11] 3,990,214

[45] Nov. 9, 1976

[54] PACKAGING APPARATUS

[75] Inventors: John T. Bell, St. Charles; Max E. Bender, Glen Ellyn, both of Ill.

[73] Assignee: Container Corporation of America, Chicago, Ill.

[22] Filed: Apr. 19, 1976

[21] Appl. No.: 678,145

[52] U.S. Cl. ..... 53/95; 53/112 B

[51] Int. Cl.[2] ..... B65B 31/02

[58] Field of Search ..... 53/79, 86, 87, 89, 95, 53/96, 112 B

[56] References Cited

UNITED STATES PATENTS

| | | | |
|---|---|---|---|
| 2,933,868 | 4/1960 | Graefingholt | 53/95 |
| 3,010,264 | 11/1961 | Christensson | 53/95 |

*Primary Examiner*—Travis S. McGehee

*Attorney, Agent, or Firm*—Carpenter & Ostis

[57] ABSTRACT

Packaging apparatus for placing reduced pressure on an open top flexible walled receptacle previously loaded at a higher ambient pressure and subsequently sealing the same, comprising a walled chamber having means therein for sealing the top of the receptacle, the chamber having a wall movable between an open position and a closed one, and having conveyor means disposed both interiorly and exteriorly of such wall, both conveyor means being selectively aligned with other conveyor means for transport of both sealed and unsealed receptacles. A preferred form of the apparatus comprehends a battery of such walled chambers where sealing of the receptacles takes place in tandem fashion, all the while movement taking place along conveyor means exterior of the walled chambers, as desired.

7 Claims, 3 Drawing Figures

PACKAGING APPARATUS

BACKGROUND OF THE INVENTION

The structure according to the present invention finds special application in the packaging of goods of small dimensions within a flexible walled receptacle which generally, in turn, is disposed within a conventional shipping container. Examples of such goods are granular or powdered material, small fruits, such as cherries packed in syrups, or the like. Such goods are generally placed within the flexible walled container at ambient pressure, and it is desirable to reduce the ambient pressure on the packaged material by placing the shipping container with the flexible walled receptacle therein within a vacuum chamber, the latter being provided with means for sealing the open top of the flexible walled container, generally by heat sealing means, the flexible walled receptacle being generally made with film material compatible with heat sealing operations.

Such loaded containers are quite heavy, and the loading of the container and the flexible walled receptacle therein within the vacuum chamber does not lend itself readily to handling by an operator.

According to the invention it is possible to arrange a plurality of vacuum chambers in tandem fashion, so that the loading into one chamber can be accomplished while another chamber is having the sealing operation carried on therein, still another chamber being unloaded after the sealing operation. The apparatus is characterized by conveyor means having conveyor sections always in alignment for movement of the shipping container to loading and unloading position, each of the chambers being characterized by a movable wall having conveyor sections mounted on the inside and outside thereof, so that at all times there is a conveyor section in alignment with the main conveyor means moving the loaded containers to position for treatment within a vacuum chamber or removal therefrom.

The apparatus is also characterized by the movable wall having elements of heat sealing means carried thereon, so that when the container is moved into position for sealing, a movable sealing bar can more cooperatively with the sealing bar carried by the movable wall to seal the flexible wall container.

THE DRAWINGS

Figure 1:
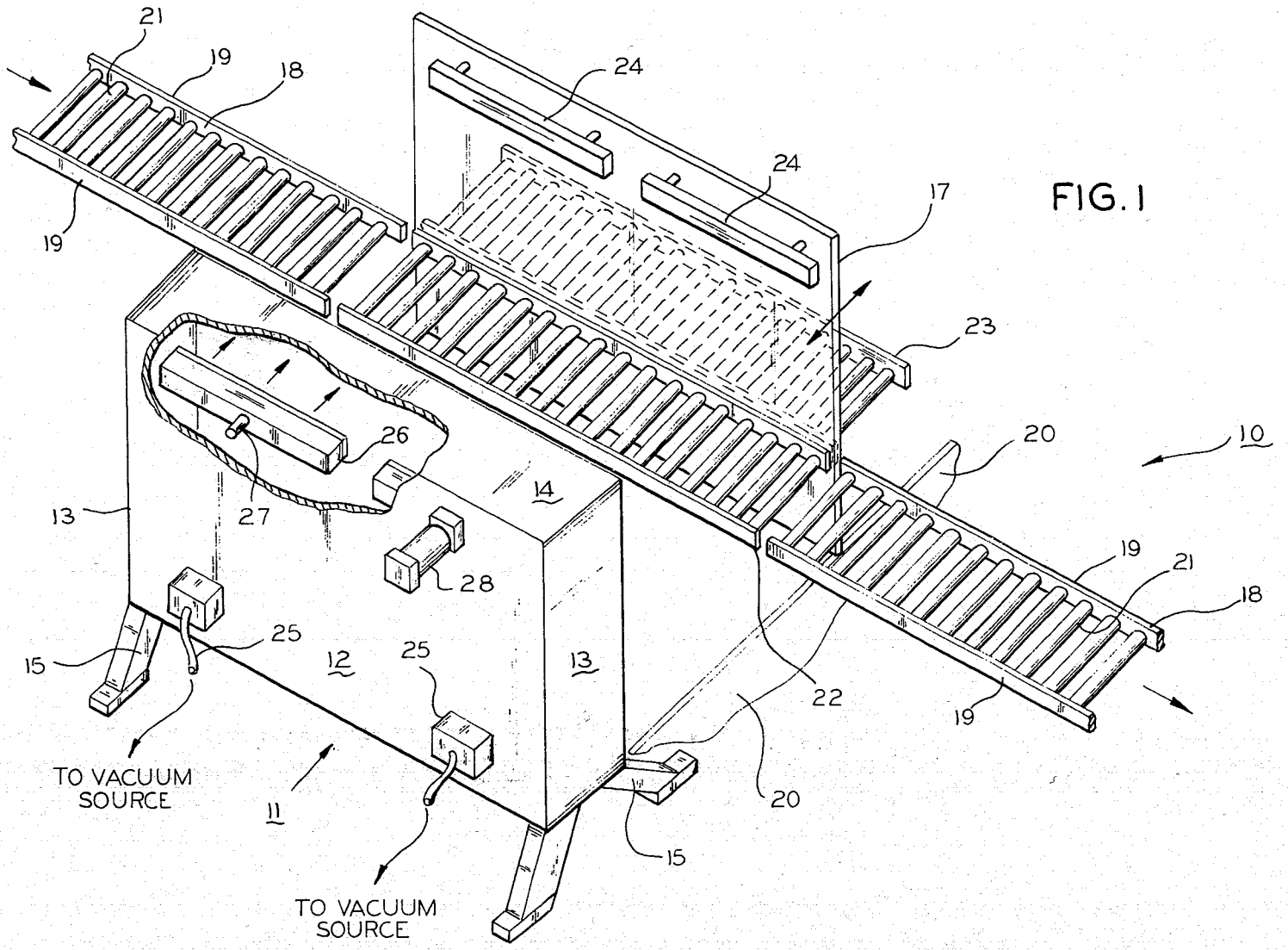
FIG. 1 is a schematic isometric view of the packaging apparatus according to the present invention.

The improved apparatus according to the present invention is denoted generally by the reference numeral 10, and includes a walled chamber 11 comprised of a back wall 12, opposed and walls 13, a top wall 14 and a bottom wall 16.

The chamber 11 is closed by a movable wall 17 mounted for movement towards and away from the walled chamber 11, along guide rails 20 shown somewhat schematically, there being one such guide rail 20 at each end of the movable wall 17 for guiding same. Gasket means, not shown, are interposed between the movable wall 17, the edges of the opposed end walls 13 and the top and bottom walls 14 and 16 respectively. The walled chamber 11 is mounted upon legs 15 at each end thereof.

Structure is provided for subjecting the chamber 11 to a pressure less than ambient when the wall 17 is closed against the chamber 11, and such means are indicated generally by the reference numeral 25 and consisting of a manifold connected to a vacuum source as shown.

Structure is provided for conveying a container body CB having a flexible walled open top receptacle FC therein as has been explained. The structure according to the present invention comprehends the sealing of two side-by-side flexible walled receptacles FC at a time, each in a shipping container body CB. Each receptable FC may be loaded with a granular product, for example, at ordinary ambient pressure. The container body CB together with the receptacle FC therein is adapted to move into position adjacent the walled chamber 11 for movement thereinto to place receptacle FC under a pressure less than the ambient pressure at which it was loaded. Such conveyor, denoted generally by the reference numeral 18, consists of laterally spaced side frames 19 supporting roller members 21 extending therebetween.

The movable wall means 17 has mounted thereon a first conveyor means 22 movable into the walled chamber 11 and supported upon the interior face of the movable wall 17, and second conveyor means 23 mounted on the outside of the wall means 17. As seen in FIG. 1, the loaded containers CB move from the conveyor 18 to the first conveyor means 22, the wall 17 moving to a position to close the chamber 11 whereupon the pressure in chamber 11 is reduced to a level less than ambient.

When the first conveyor means 22 and the movable wall 17 are in the position described, the second conveyor means 23 is in a position of alignment with the conveyor 18, and the second container bodies CB can move past the walled chamber 11 for treatment in like apparatus located downstream of the second conveyor means 23.

While the loaded container bodies CB are within the walled chamber 11, the open top of OT of each receptacle FC is sealed, the inside of the movable wall 17 having a pair of sealing bars 24 movable into engagement with an open top OT. These cooperate with movable sealing bars 26 mounted at the end of piston rods 27 movable by cylinders 28. Sealing bars 26 are provided with heating elements, not shown, and when the bars 24 and 26 are in engagement with open tops OT of the receptacles FC therebetween, the open tops OT can be sealed. Such sealing operation takes place after the ambient pressure within the chamber 11 has been reduced to a desired value.

Figure 2:
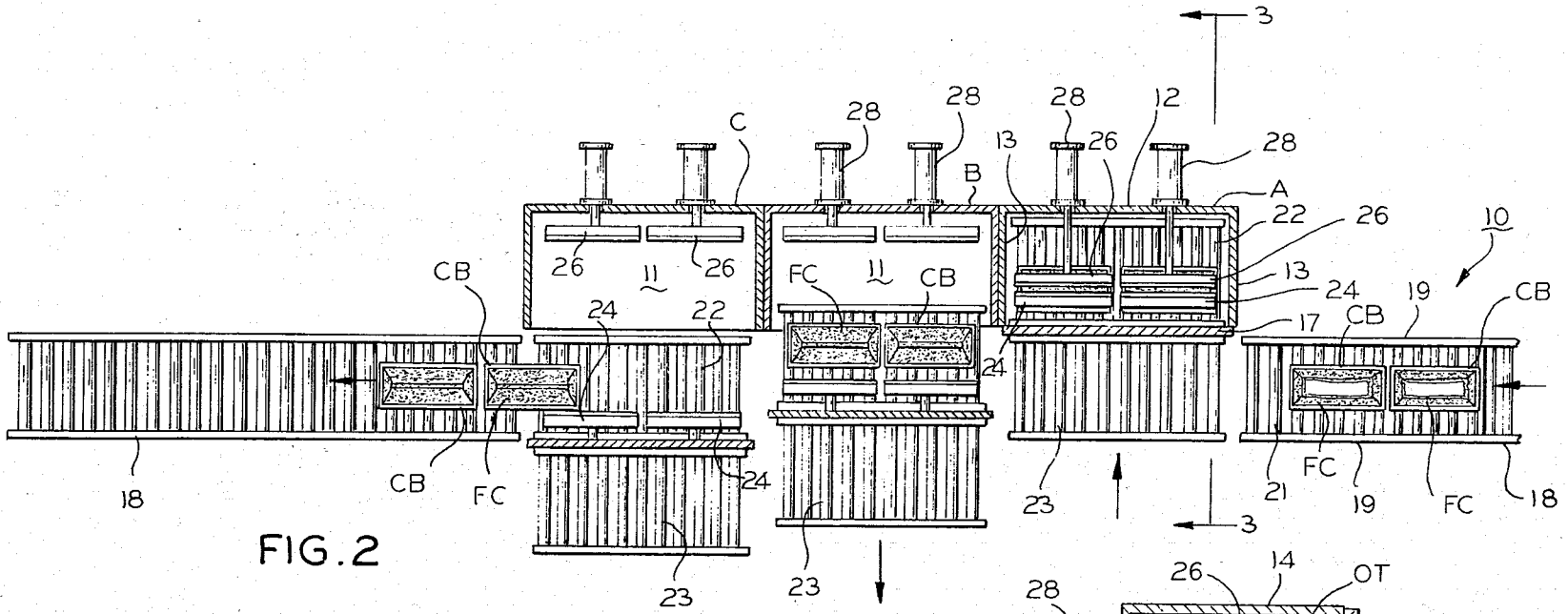
FIG. 2 is a plan view showing a number of chambers of the kind seen in FIG. 1, arranged in tandem fashion, and showing containers in various stages of the sealing operation of the flexible wall container therein.
Figure 3:
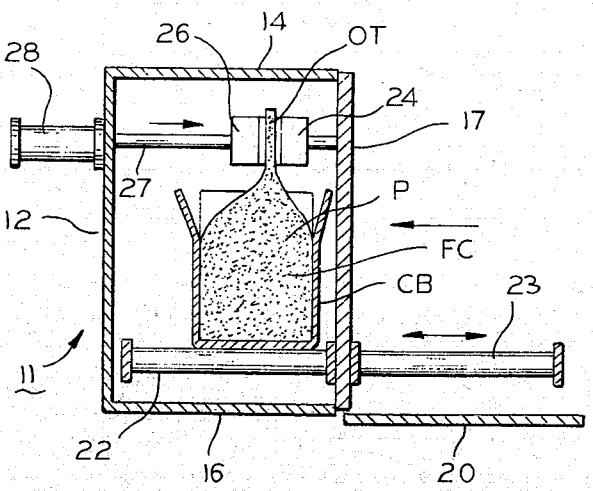
FIG. 3 is a sectional view taken along the line 3—3 of FIG. 2 looking in the direction of the arrows.

As seen in FIG. 2 the walled chambers 17 can be arranged in tandem fashion, they being denoted by the initials A, B and C. Walled chamber A is at this time loaded with the container bodies CB and is undergoing the sealing operation previously described. Walled chamber B has had the sealing operation therein completed and the wall 17 is retreating so that its first conveyor means 22 is in alignment with the second conveyor means 23 of chamber A. When so aligned, the sealed receptacles FC within the container bodies CB of chamber B can move on to the first conveyor means 22 of chamber C, the conveyor means thereat being in alignment with conveyor 18 for removal of the completely sealed receptacles FC.

The operation of the chambers A, B and C can be carried on by a single operator and the sequence of operations taking place within each chamber A, B or C can be readily understood, Control means, not shown, can be provided for moving the walls and their associated first and second conveyor means into proper position, and structure may be provided for moving the movable wall 17 along the rails 20. Such control means form no part of the present invention, and so are not described.

We claim:

1. Apparatus for placing reduced pressure on and subsequently sealing an open top flexible walled receptacle previously loaded at a higher ambient pressure, said apparatus comprising:

a. a walled chamber including wall means movable between positions closing and opening said chamber to ambient pressure;

b. means subjecting said chamber when closed to a pressure less than ambient;

c. means for conveying an open top receptacle previously loaded at ambient pressure for reduction of the pressure therein to a reduced value;

d. means for sealing said receptacle while in said closed chamber when said chamber has the pressure therein reduced below the ambient pressure;

e. first and second additional conveyor means mounted on said wall means on opposite sides thereof;

f. all of said conveyor means being adapted to transport said receptacle for reduction of the pressure therein and for sealing of same;

g. said first additional conveyor means supporting said receptacle within said chamber while the same is closed by said wall means for reduction of the ambient pressure in said receptacle and sealing same; and h. said second additional conveyor means moving another of said receptacles to position for similar treatment of the contents loaded therein.

2. The apparatus according to claim 1 wherein said first and second additional conveying means move selectively to positions of alignment with said first named conveying means.

3. The apparatus according to claim 2 wherein said first and second conveyor means move laterally to said position of alignment.

4. The apparatus according to claim 1 wherein said walled chambers are arranged in a row and wherein said movable wall means are operable for movement of a receptacle into the associated chamber of said wall means for reduction of pressure in said chamber and the sealing of said receptacle.

5. The apparatus according to claim 1 wherein said movable wall means supports a portion of said sealing means.

6. The apparatus according to claim 1 wherein said sealing means includes a sealing bar supported by said movable wall means, and said walled chamber supports a movable sealing bar movable with respect to said receptacle and said first named sealing bar to seal said open top.

7. A vacuum chamber arrangement for subjecting an article to a change of pressure, comprising:

a. a plurality of housings each having a stationary section and a movable section mounted for movement toward and away from said stationary section to close and open said housing;

b. primary conveyor means including conveyor sections disposed forwardly and rearwardly of said housings in alignment with each other;

c. each of said movable sections having mounted on opposite sides thereof outboard and inboard secondary conveyor sections arranged and disposed for alternate alignment with said primary conveyor means so that when a housing is open, an article can move onto or off said inboard conveyor section and when said housing is closed an article can bypass said housing on said outboard conveyor section.

* * * * *